US006561838B1

(12) United States Patent
Blichfeldt

(10) Patent No.: US 6,561,838 B1
(45) Date of Patent: May 13, 2003

(54) CONNECTOR PLUG AND INSERT FOR TWISTED PAIR CABLES

(75) Inventor: Bradley J. Blichfeldt, Burnsville, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 09/459,706

(22) Filed: Dec. 13, 1999

(51) Int. Cl.[7] ..... H01R 4/24
(52) U.S. Cl. ..... 439/418
(58) Field of Search ..... 439/344, 418, 439/460, 676

(56) References Cited

U.S. PATENT DOCUMENTS

| | | | | | |
|---|---|---|---|---|---|
| 4,506,944 | A | | 3/1985 | Brennan et al. | |
| 4,516,825 | A | | 5/1985 | Brennan et al. | |
| 4,607,905 | A | * | 8/1986 | Vaden | 339/176 |
| 4,653,837 | A | | 3/1987 | Phillipson et al. | |
| 4,767,355 | A | | 8/1988 | Phillipson et al. | |
| 4,978,316 | A | * | 12/1990 | Yahata | 439/449 |
| 5,059,140 | A | | 10/1991 | Philippson et al. | |
| 5,147,215 | A | * | 9/1992 | Pritulsky | 439/344 |
| 5,194,014 | A | | 3/1993 | McClune et al. | |
| 5,203,717 | A | * | 4/1993 | Beck et al. | 439/460 |
| 5,505,638 | A | | 4/1996 | Su et al. | |
| 5,571,035 | A | | 11/1996 | Ferrill | |
| 5,628,647 | A | | 5/1997 | Rohrbaugh et al. | |
| 5,700,167 | A | * | 12/1997 | Pharney et al. | 439/676 |
| 5,727,962 | A | | 3/1998 | Caveney et al. | |
| 5,772,465 | A | | 6/1998 | Hwang et al. | |
| 5,830,005 | A | * | 11/1998 | Watanabe | 439/418 |
| 5,888,100 | A | * | 3/1999 | Bofill et al. | 439/676 |
| 5,899,770 | A | * | 5/1999 | Ezawa | 439/418 |
| 5,961,354 | A | | 10/1999 | Hashim | |
| 5,975,943 | A | * | 11/1999 | Chou et al. | 439/490 |
| 5,984,713 | A | | 11/1999 | Hsien | |
| 6,017,237 | A | * | 1/2000 | Sullivan | 439/392 |
| 6,080,007 | A | | 6/2000 | Dupuis et al. | |
| 6,083,052 | A | | 7/2000 | Adams et al. | |
| 6,113,400 | A | * | 9/2000 | Martin et al. | 439/76.1 |
| 6,193,542 | B1 | | 2/2001 | Marowsky et al. | |

FOREIGN PATENT DOCUMENTS

| | | |
|---|---|---|
| EP | 0 716 477 A2 | 6/1996 |
| EP | 0 840 406 A2 | 5/1998 |
| EP | 0 716 477 A3 | 3/1999 |
| EP | 0 840 406 A3 | 3/1999 |
| EP | 0 948 099 A1 | 10/1999 |
| WO | WO 00/74178 | 12/2000 |

OTHER PUBLICATIONS

Photographs of a Stewart connector crimped directly to a cable.
Photographs of an Ortronics cable and insert mounted to a Stewart connector.
Photographs of the connector and cable of Exhibit B with the connector partially broken away.
The Siemon Company Catalog pages—front cover pp. 6.0–6.11, and back cover page, copyright 1998.

* cited by examiner

*Primary Examiner*—Lynn D. Feild
*Assistant Examiner*—Thanh-Tam Le
(74) *Attorney, Agent, or Firm*—Merchant & Gould P.C.

(57) ABSTRACT

A connector plug for twisted pair cables includes an insert within the plug disposed around the twisted pairs of wires. The insert include enclosed chambers, each sized for one pair of wires. The insert protects the wires from the crimp of the plug. A cross-over region in the insert allows the wires of certain pairs to cross over for proper positioning adjacent the contacts of the plug.

19 Claims, 4 Drawing Sheets

CONNECTOR PLUG AND INSERT FOR TWISTED PAIR CABLES

BACKGROUND OF THE INVENTION

The present invention relates to connector plugs for connecting bundled cable wires into wire jacks.

Telecommunications cable lines are typically connected into port or jack terminals using plug connectors that enable the cables to be easily connected and disconnected. The cable lines are comprised of a number of wire pairs surrounded by a cable jacket. Quick connect cables are often constructed by securing a connector plug to the end of the cable wires and sliding the connector plug into a matching port terminal where it locks into place with a simple lever lock. An RJ45 type connector is one example. To secure the connector plug to the end of the cable wires, the plug is crimped onto the end of the cable. By crimping the connector plug, a portion of the plug permanently grips the cable. In prior art connector plugs, the crimping of the cable often results in damage to the wires within the cables. At higher frequencies the deleterious effects of wires flattened or creased by crimping is more pronounced.

Crimping damage is often caused when the wires inside the cable enter the plug in a clustered group. Although the crimping mechanism is less likely to damage an individual wire or even a pair of wires stacked on top of each other, the crimping mechanism will damage larger stacks of wires. Therefore, when the wires of the cable enter the crimping plug in a large cluster of overlapping wires, damage from crimping is likely. There is a need to address the crimp damage issue, especially for connectors desired for use at higher frequencies, such as 250 MHz for category 6 connectors.

SUMMARY OF THE INVENTION

The present invention provides an apparatus and method to address crimp damage by sorting the wires into an orderly arrangement as they enter the connector plug and as they pass under the crimping mechanism. A connector plug assembly arranges the wire pairs as they enter the connector plug housing and protects the wires from the crimping mechanism used to secure the connector plug housing to the wire cable.

In accordance with one aspect of the invention, an insert is provided for positioning over the wire pairs, with each pair positioned in an enclosed chamber of the insert. The enclosed chambers extend parallel to one another in a single row. The insert is received in the connector plug housing adjacent the cable crimp.

In accordance with another aspect of the invention, the insert is provided with organizing regions for organizing the wire pairs, and a crossing space in communication with two adjacent organizing regions for allowing wires within two adjacent regions to cross over each other. The insert is received in the connector plug housing adjacent to the cable crimp.

DETAILED DESCRIPTION OF THE PREFERRED EMBODIMENT

Figure 1:
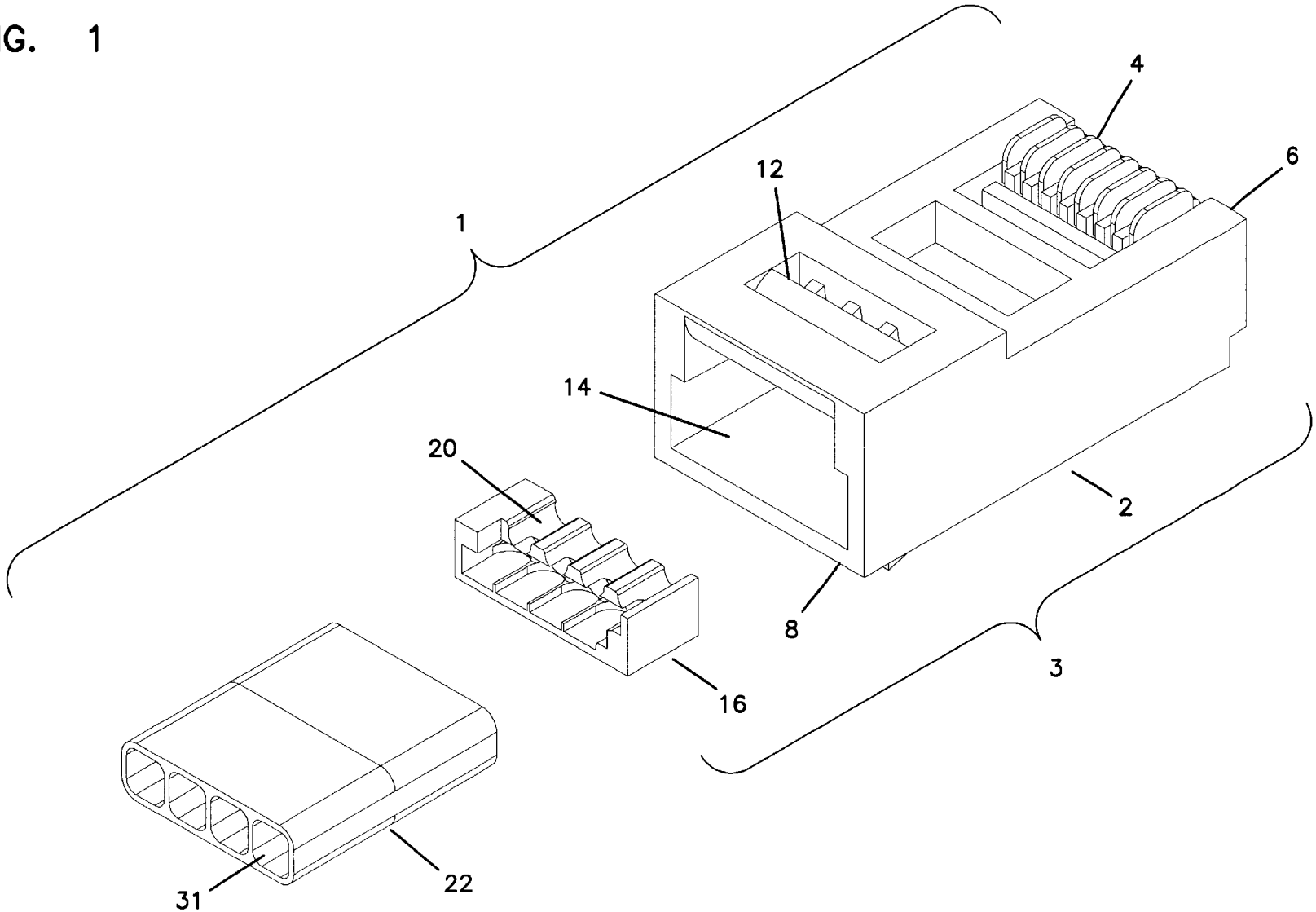
FIG. 1 shows a perspective view of one disassembled embodiment of the invention for a connector plug assembly including a connector plug and an insert.
Figure 2:
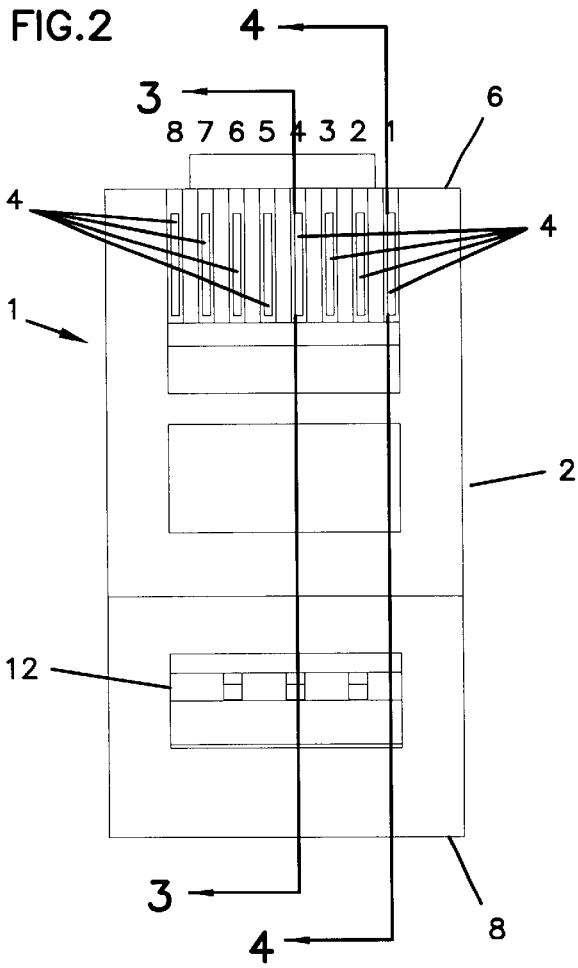
FIG. 2 shows a top view of the connector plug assembly of FIG. 1 in the assembled condition, before crimping, and with the wires not shown.
Figure 3:
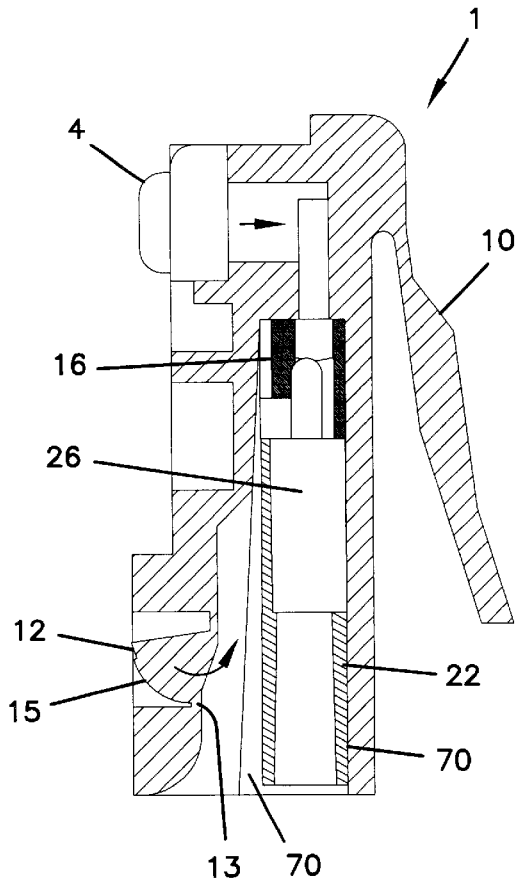
FIG. 3 shows a cross-sectional view of the connector plug of FIG. 2 assembly along line 3—3.
Figure 4:
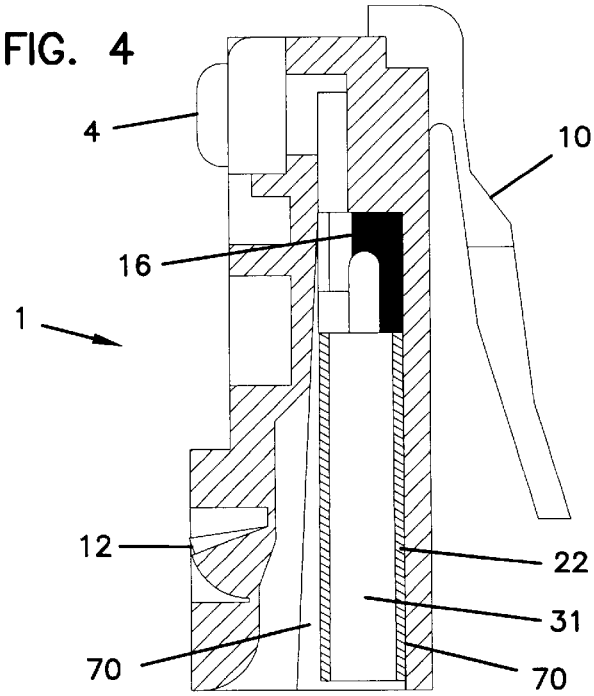
FIG. 4 shows another cross-sectional view of the connector plug of FIG. 2 assembly along line 4—4.

Referring to the drawings, FIGS. 1–5 show one embodiment of a connector plug assembly 1 in accordance with the present invention. The assembly 1 includes a plug housing 2, a comb 16, and an insert 22. The comb 16 fits within the plug housing 2 as shown in FIGS. 3 and 4. The plug housing 2 and the comb 16 form a connector 3 which is generally known in the art. In the example shown the connector 3 is an RJ45 4 pair connector by the Stewart Connector Systems. Inc. of Glen Rock, Pa. The plug housing 2 of the connector 3 is configured to fit into a reciprocally shaped wire jack. The plug housing 2 is secured to an end of a cable by crimping device 12 as is known in the art. In use, webbing 13 of crimping device 12 is broken by a crimping tool and body 15 is rotated as shown to crimp to the cable within plug housing 2. Also, conductive contacts 4 are pressed into plug housing 2 by the crimping tool to contact the wire ends of the cable. Typically the plug housing 2 is secured in the wire jack by a flexible securing clip 10.

A cable wire typically comprises a number of twisted wire pairs. The embodiment of the invention shown in the figures is designed to accommodate a cable with four wire pairs. Each wire is individually insulated, and in order to identify the wires each wire insulation is often colored differently. Typically, one wire of each wire pair is a solid color while the other wire of the pair is striped. A cable jacket surrounds all of the wire pairs to form a cable.

The plug housing 2 electrically connects the cable having multiple wires into the wire jack. The comb 16 aligns the individual wires with conductive contacts 4 inside an interior chamber 14 of the plug housing 2. FIGS. 3 and 4 show the comb 16 disposed within the plug housing 2 adjacent to the conductive contacts 4. The insert 22 orders the wire pairs as the pairs enter the back end 8 of the plug housing 2. The insert 22 protects the wires from damage caused by the crimping process.

Referring to FIGS. 3 and 4, the comb 16 and the insert 22 are configured to fit into the interior chamber 14 of the plug housing 2. The insert 22 guides the wire pairs to the comb 16. The comb 16 then guides the individual wires to the conductive contacts 4 of the plug housing 2.

Figure 6:
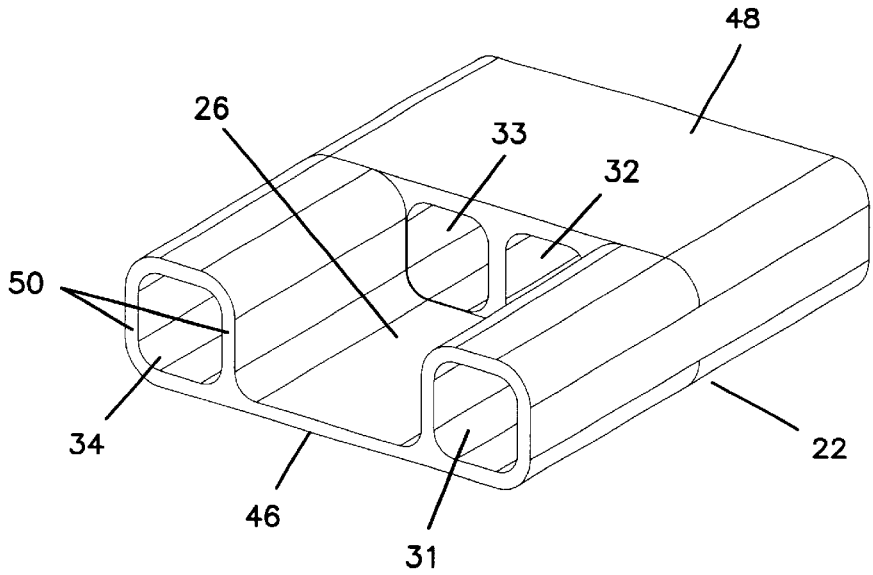
FIG. 6 shows a perspective view of the insert of the present invention.
Figure 7:
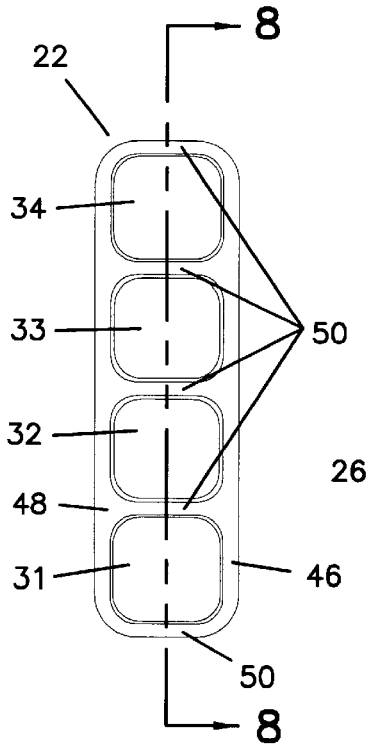
FIG. 7 shows a rear end view of the insert of FIG. 6.
Figure 8:
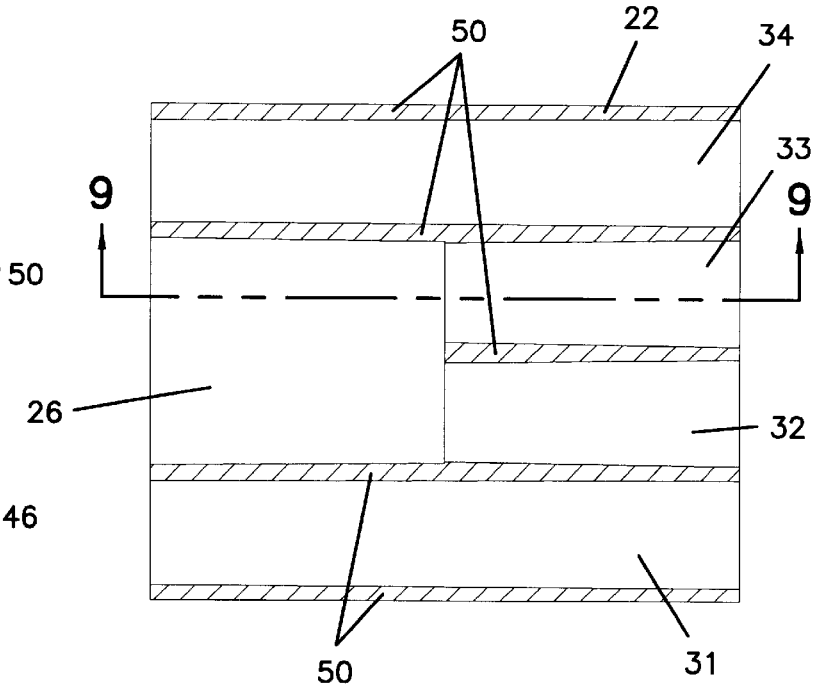
FIG. 8 shows a cross-sectional top view of the insert along line 8—8 of FIG. 7.
Figure 9:
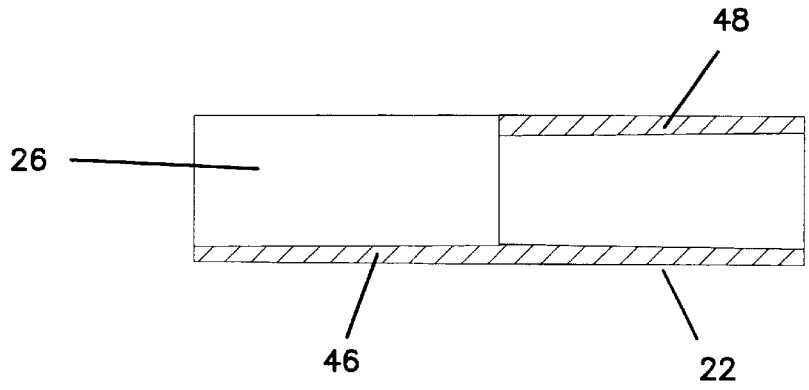
FIG. 9 shows a cross-sectional side view of the insert along line 9—9 of FIG. 8.

FIG. 6 shows a perspective view of one embodiment of the insert 22. The insert 22 orders the twisted wire pairs by preferably confining each wire pair to a separately enclosed channel 31–34. Each channel 31–34 is sized so that it can house one wire pair. The insert 22 acts to prevent the wire pairs from passing beneath the crimping device 12 in an overlapping clump. The wire pairs are normally clustered together in overlapping positions over the length of the cable, but if the wire pairs are permitted to remain in this clustered orientation as they pass under the crimping means, the crimping device will tend to smash the wires against each other. This produces poor performance especially at higher frequencies. By sheathing the wire pairs inside the insert 22, the wire pairs are prevented from overlapping as they pass beneath the crimp device 12 of the plug housing 2. The insert 22 is preferably sufficiently rigid to generally retain its shape, even under the influence of the crimp. This further protects the wires from being crushed by the crimp. The insert 22 can be made of molded plastic, such as ABS.

The insert 22 may be configured with as many channels as there are wire pairs in the cable. The figures show one embodiment configured for four wire pairs. In the embodiment shown in FIG. 6, the insert 22 is constructed of two parallel planar outside wall surfaces 46 and 48. The outside wall surfaces 46 and 48 are connected by a series of dividing walls 50 generally perpendicular to the outside wall surfaces 46 and 48. The outside wall surfaces 46 and 48 act with the dividing walls 50 to define the separately enclosed channels 31–34. In one preferred embodiment, the channels 31–34 are configured as having parallel longitudinal axes. The channels 31–34 are also configured so that the longitudinal axis of each channel lies in a common plane. Additional rows and arrangements for the wires are possible for use with other wire types and connector types.

The insert 22 may be configured such that the interior dividing walls are only partial walls or other dividing structures. In such a configuration there may not be separately enclosed channels. Rather, the wire pairs would be guided oy the partial walls or other structures to remain in different regions of the insert. These guiding or organizing regions may be configured with the partial walls or other structures to separate the wire pairs without completely enclosing the wire pairs within separate channels.

The insert 22 preferably also defines a central open space 26. The open space or crossing space 26 permits wires from two adjacent channels or regions to cross over each other before entering the comb 16 and connecting to the conductive contacts 4. Typically, a wire from one of the wire pairs must be connected to a conductive contact 4 other than a contact which is adjacent to the other wire in the wire pair. That is, the first wire of one of the wire pairs is not be connected to a conductive contact adjacent to the conductive contact of the second wire in the wire pair. This configuration is achieved by crossing the wire with one or more wires from an adjacent wire pair. The open space 26 permits these wires to cross without being damaged by the crimp 14. The open space 26 is formed by using a shortened central wall 50, and an open space in wall surface 48. The open space 26 forms a lateral access location to access an interior of portions of the insert 22. In the present embodiment, access is provided to the wire pairs for channels 32 and 33, to allow for untwisting and crossing over for proper alignment for the conductive contacts 4 in the plug housing 2.

Figure 10:
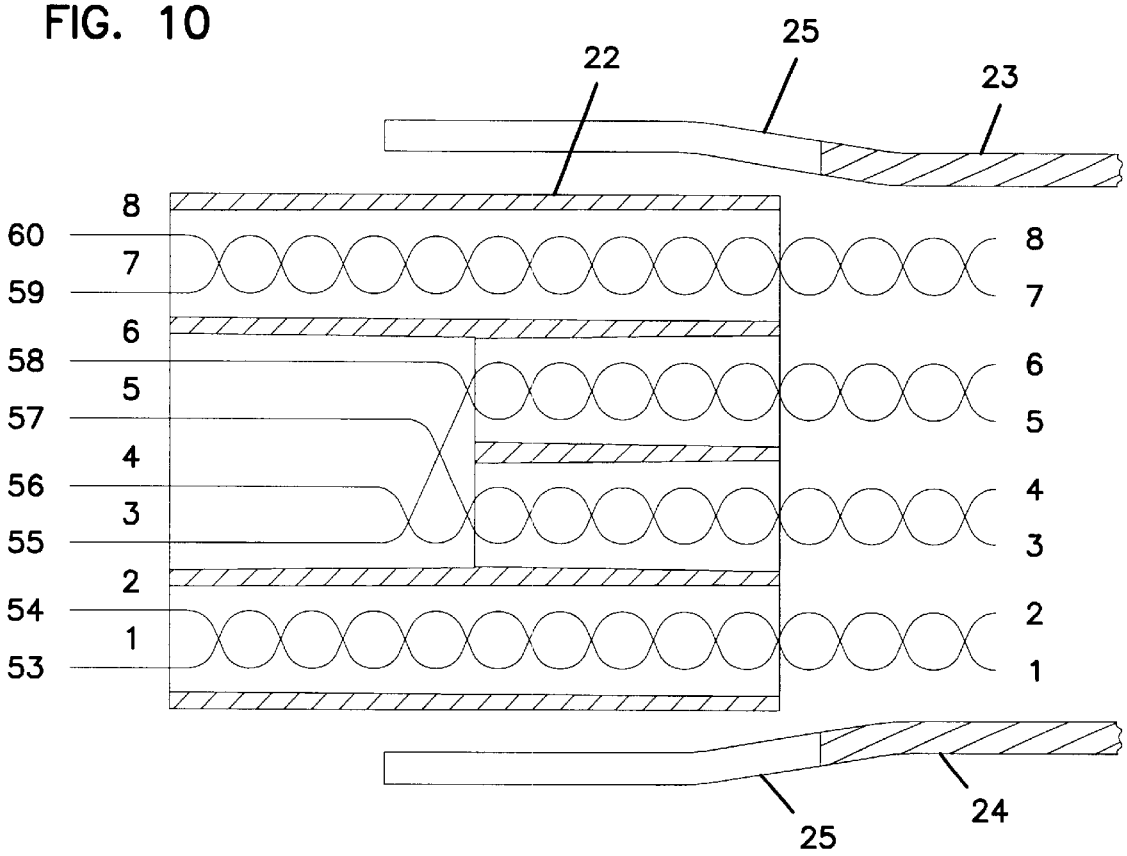
FIG. 10 shows the cross-sectional top view of FIG. 8 with schematic lines representing wires and wire pairs.

FIGS. 6 through 10 all show one embodiment of the insert 22 having an open space or access space 26 defined by an outside surface 46 and two divider walls 50. The open space 26 is in communication with two adjacent channels 33 and 32, thereby allowing wires from-the middle two channels 32 and 33 to cross over each other before entering the comb 16. Referring to FIG. 10, the figure schematically shows how one wire 55 is able to cross over the wires of an adjacent wire pair of wires 56 and 57 within the open space 26 defined by the insert 22. A representative cable 23 is also shown in FIG. 10 with a jacket 24 and wires 53–60. Within the jacket 24, wires 53–60 are arranged in twisted pairs 1–2, 4–5, 3–6, and 7–8. The conductive contacts 4 are typically arranged in order 1–8, as shown in FIGS. 2 and 10. Open space 26 allows for proper alignment of wires 55–58 corresponding to wire/contact numbers 3–6.

Figure 5:
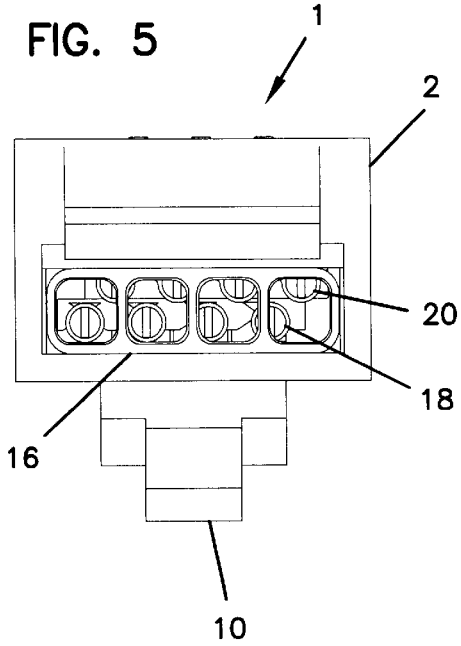
FIG. 5 shows a rear end view of the plug assembly.

Referring to FIGS. 1 and 5, the comb 16 defines a plurality of guide-holes 18 through which one wire from each wire pair is threaded after being untwisted from the other wire of the pair. The comb 16 also defines a plurality of snap-slots 20 into which the remaining wires of the wire pairs are slotted. In such a configuration the comb 16 aligns the wires individually to be connected to the conductive contacts 4 of the plug housing 2. FIGS. 3 and 4 show the comb 16 and the insert 22 fitted inside the plug housing 2. FIG. 3 is a cross-section of the assembly showing the open space 26 defined by the insert 22.

The insert 22, the comb 16, the plug housing 2 and the cable wires 53–60 are assembled to the cable 23 by first stripping away a portion of the cable jacket 24 at the end of the cable to expose the twisted wire pairs. Two slits 25 are then cut into the remaining cable jacket to allow the insert 22 to slide over the wire pairs underneath the end of the cable jacket. The two slits are made on opposite sides of the cable jacket near the wire pairs to be threaded through the outside channels of the insert 22. The cable pairs are then threaded through the channels or organizing regions of the insert 22, and the insert 22 is slid at least partially inside the cable jacket. The wire pairs are untwisted and separated. One wire from each pair (e.g. striped wires) is pulled back from the other (e.g. colored wires). The striped colored wires are inserted through the guide-holes 18 of the comb 16, and the solid colored wires are snapped into the slots 20 of the comb 16. The ends of the wires are cut and the wires are slid inside the comb 16 so that the ends of the wires are flush with an end face of the comb 16. The comb 16 is inserted into the plug so that the wires of the cable are aligned with the conductive contacts 4, and, the insert 22 is also positioned within the plug. The slit cable jacket 24 is positioned within plug on opposite side 70 of the insert 22. Finally, the plug housing 2 is crimped by crimp device 12 and a crimp tool to secure the cable into the plug housing 2, and the conductive contacts 4 are pressed into the wire ends. As shown, the insert 22 abuts the comb 16 for ease of use and alignment of the insert 22 under the crimp device 12.

The insert 22 of the preferred embodiment groom the wire pairs from the multi-pair cable to prevent a clump of the wires from being crushed or misaligned during the crimping operation. Also, insert 22 permits appropriate crossing over of wires from wire pairs groomed by the insert 22 for proper positioning for contacting the conductive contacts 4 of the plug housing 2. Insert 22 also preferably has sufficient rigidity to at least partially support the crimp device and limit excessive crushing or damage to the groomed wire pairs. Use of the insert 22 is intended to reduce crimp damage in ungroomed wire pairs, thereby improving electrical performance of the plug.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An insert for arranging a set of wires leading into a crimped plug to prevent damage to the wires during crimping, the insert comprising: a body defining a plurality of separately enclosed channels each channel sized to receive a wire pair, the body further defining an open crossing space in communication with at least two adjacent channels for allowing wires from the two adjacent channels to cross over each other, wherein the two adjacent channels are each characterized by a longitudinal axis and wherein the longitudinal axes of the two adjacent channels lie in a first plane that is parallel to a second plane defined by a top surface of the insert.

2. The insert of claim 1 wherein the enclosed channels are each characterized by a longitudinal axis, the longitudinal axes of the channels being substantially parallel to one another.

3. The insert of claim 2 wherein the channels are aligned so that the longitudinal axis of each channel lies substantially in a common plane.

4. The insert of claim 1 wherein the body defines four channels: a first channel, a second channel, a third channel and a fourth channel.

5. The insert of claim 4 wherein the four channels are characterized by parallel longitudinal axes, the parallel channel axes being aligned in a common plane so that the second and third channels are adjacent, the second and third channels being inside channels which separate the first and fourth outside channels, and wherein the crossing space defined by the insert body is in communication with the second and third channels.

6. An insert for arranging a set of wires leading into a crimped plug to prevent damage to the wires during crimping, the insert comprising: a body defining a plurality of parallel enclosed channels, each channel aligned in a common plane and each channel sized to receive a wire pair, the body also defining a crossing space in communication with two adjacent channels for allowing wires within the two adjacent channels to cross over each other, wherein the crossing space is defined by a shortened wall separating the two adjacent channels, the two adjacent channels each characterized by a longitudinal axis and wherein the longitudinal axes of the two adjacent channels lie in a first plane that is parallel to a second plane defined by a top surface of the insert.

7. The insert of claim 6 wherein the body defines four parallel channels.

8. The insert of claim 7 wherein two of the channels are inner adjacent channels, the inner adjacent channels separating two outer channels, and wherein the crossing space defined by the insert body is in communication with the two inside channels, and wherein the body includes major planar surfaces, the crossing space defining an access region in one of the major planar surfaces.

9. A crimping plug assembly for connecting a set of wires to a wire plug, the plug assembly comprising:

a connector housing for receiving and holding an end of the wires by crimping onto the ends of the wires, the connector housing having a plurality of conductive contacts, a front end, a back end, a securing clip, a crimp, the housing defining an interior chamber accessible through the back end of the housing;

a connector comb for aligning the wires with the conductive contacts of the connector housing, the comb defining a plurality of separately enclosed guide-holes sized to receive individual wires, the comb further defining a plurality of slots also sized to receive individual wires, wherein the guide-holes receive a first set of wires in a first plane and the slots receive a second set of wires in a second plane spaced from the first plane thereby aligning both the first set of wires and the second set of wires with the conductive contacts of the connector housing; and an insert having a body defining a plurality of separately enclosed channels each channel sized to receive a wire pair, the insert received in the interior chamber of the connector housing under the crimp, wherein the insert arranges the wire pairs to prevent damage to the wire pairs when crimped by the connector housing, the body also defining a crossing space in communication with two adjacent channels for allowing wires within the two adjacent channels to cross over each other, the two adjacent channels each characterized by a longitudinal axis and wherein the longitudinal axes of the two adjacent channels lie in a first plane that is parallel to a second plane defined by a top surface of the insert.

10. The crimping plug assembly of claim 9 wherein the insert body defines four separately enclosed channels all lying in a common plane: a first channel, a second channel, a third channel, and a fourth channel.

11. The crimping plug assembly of claim 9 wherein the separately enclosed channels are all in a common plane and are each characterized by a longitudinal axis, the longitudinal axes of the channels being substantially parallel to one another.

12. The crimping plug assembly of claim 10 wherein the insert body further defines a crossing space in communication with at least two adjacent channels for allowing wires from the two adjacent channels to cross over each other.

13. A crimping plug assembly for connecting a set of wires to a jack, the plug assembly comprising:

a connector housing for receiving and holding an end of the wires by crimping onto the ends of the wires, the connector housing having a plurality of conductive contacts, a front end, a back end, a securing clip, a crimp, the housing defining an interior chamber accessible through the back end of the housing, and a connector comb for aligning the wires with the conductive contacts of the connector housing, the comb defining a plurality of guiding regions, and an insert having a body defining a plurality of parallel enclosed channels, each channel aligned in a common plane, each channel sized to receive a twisted wire pair, the body also defining a crossing space in communication with two adjacent channels for allowing wires within the two adjacent channels to cross over each other, the two adjacent channels each characterized by a longitudinal axis, the longitudinal axes of the two adjacent channels lying in a first plane that is parallel to a second plane defined by a top surface of the insert, wherein the insert acts to arrange the wires to prevent damage to the wires when crimped by the connector housing.

14. An insert for arranging a set of wires leading into a crimped plug to prevent damage to the wires during crimping, the insert comprising: a body defining a plurality of separately enclosed channels each channel sized to receive a wire pair wherein the enclosed channels are each characterized by a longitudinal center axis, the longitudinal center axes of the channels being parallel to one another and lying in a common plane, the body also defining a crossing space in communication with two adjacent channels for allowing wires within the two adjacent channels to cross over each other, the longitudinal center axes of the two adjacent channels lying in a first plane that is parallel to a second plane defined by a top surface of the insert.

15. The insert of claim 14 wherein the body defines four channels, the channels being defined by two parallel planar outside wall surfaces and a series of five parallel dividing walls which are perpendicular to the outside wall surfaces and which connect the two outside wall surfaces, wherein the channels are characterized by a cross section which is in the shape of a square.

16. A crimping plug assembly for connecting a cable of wires to a jack, the plug assembly comprising:

a connector housing having a front end, a back end, a securing clip, a crimp, and a plurality of conductive contacts, the housing defining an interior chamber accessible through the back end of the connector housing;

a connector comb defining a plurality of guide-openings, the connector comb having a front end and a back end, the connector comb received in the interior chamber of the connector housing so that the front end of the connector comb is toward the front end of the housing and positioned to align the wires with the conductive contacts of the connector housing;

an insert having a front end, a back end, and at least one divider wall, the insert defining a first organizing region sized to receive a twisted wire pair extending from the back end of the insert, the insert defining a second organizing region sized to receive a twisted wire pair extending from the back end of the insert, the first organizing region being separated from the second organizing region by the at least one divider wall, the insert received in the interior chamber of the connector housing under the crimp, the front end of the insert adjacent to the back end of the comb, the at least one divider wall being sufficiently rigid to protect the twisted wire pairs under the crimp, each organizing region being an enclosed channel, the insert also defining a crossing space through the divider wall in communication with the first and second regions for allowing wires within the first and second regions to cross over each other, the first and second regions each characterized by a longitudinal axis, the axes of the first and second regions lying in a first plane that is parallel to a second plane defined by a top surface of the insert; and first and second twisted wire pairs disposed within the first and second organizing regions respectively, each wire of the twisted wire pairs being disposed in the guide-openings of the comb and in electrical contact with the contacts of the connector housing.

17. The plug assembly of claim 16 wherein the insert defines a third and a fourth organizing regions each sized to receive a twisted wire pair from the back end of the insert, each organizing region being separated from the other organizing region by at least one divider wall, and wherein the plug assembly includes third and fourth twisted wire pairs disposed within the third and fourth organizing regions respectively, each wire of the wire pairs being disposed in the guide-openings of the comb and in electrical contact with the contacts of the connector housing.

18. A crimping plug assembly for connecting a cable of twisted wire pairs to a jack, the plug assembly comprising:

a connector housing having a front end, a back end, a securing clip, a crimp, and a plurality of conductive contacts, the housing defining an interior chamber accessible through the back end of the connector housing; and an insert received in the interior chamber of the connector housing under the crimp, the insert having a front end, a back end, and a divider wall structure, the insert defining a first organizing region sized to receive a first twisted wire pair from the back end of the insert and positioned to guide the first twisted wire pair under the crimp, the insert defining a second organizing region sized to receive a second twisted wire pair from the back end of the insert and positioned to guide the second twisted wire pair under the crimp, the first organizing region being separated from the second organizing region by the divider wall structure, each organizing region being an enclosed channel, the insert also defining a crossing space through the divider wall structure in communication with the first and second regions for allowing wires within the first and second regions to cross over each other, the first and second regions each characterized by a longitudinal axis, the axes of the first and second regions lying in a first plane that is parallel to a second plane defined by a top surface of the insert.

19. The plug assembly of claim 18 wherein the insert defines a third and a fourth organizing region each sized to receive a twisted wire pair from the back end of the insert, each organizing region being separated from the other organizing regions by the divider wall structure.

* * * * *

UNITED STATES PATENT AND TRADEMARK OFFICE

CERTIFICATE OF CORRECTION

PATENT NO. : 6,561,838 B1
DATED : May 13, 2003
INVENTOR(S) : Blichfeldt

It is certified that error appears in the above-identified patent and that said Letters Patent is hereby corrected as shown below:

Column 8,
Line 2, "regions" should read -- region --
Line 5, "region" should read -- regions --

Signed and Sealed this

Twenty-second Day of July, 2003

JAMES E. ROGAN
*Director of the United States Patent and Trademark Office*